US007790643B2

(12) United States Patent
Kanda et al.

(10) Patent No.: US 7,790,643 B2
(45) Date of Patent: Sep. 7, 2010

(54) URETHANE FOAM REINFORCING MATERIAL

(75) Inventors: Kazunori Kanda, Tsuruga (JP); Kazuhiro Teramae, Tsuruga (JP); Toshiya Yamamoto, Tokyo (JP)

(73) Assignee: Toyo Boseki Kabushiki Kaisha, Osaka (JP)

( * ) Notice: Subject to any disclaimer, the term of this patent is extended or adjusted under 35 U.S.C. 154(b) by 0 days.

(21) Appl. No.: 12/304,565

(22) PCT Filed: Jun. 14, 2007

(86) PCT No.: PCT/JP2007/061980

§ 371 (c)(1),
(2), (4) Date: Dec. 30, 2008

(87) PCT Pub. No.: WO2007/145271

PCT Pub. Date: Dec. 21, 2007

(65) Prior Publication Data

US 2009/0247037 A1 Oct. 1, 2009

(30) Foreign Application Priority Data

Jun. 15, 2006 (JP) ..... 2006-166277

(51) Int. Cl.
*D04H 1/46* (2006.01)

(52) U.S. Cl. ..... 442/402

(58) Field of Classification Search ..... 442/370, 442/373, 374, 375, 381, 382, 383, 387, 388, 442/389, 392, 393, 402
See application file for complete search history.

(56) References Cited

U.S. PATENT DOCUMENTS

| | | | | |
|---|---|---|---|---|
| 6,093,481 | A * | 7/2000 | Lynn et al. | 428/217 |
| 2005/0130541 | A1 * | 6/2005 | Shah | 442/386 |

FOREIGN PATENT DOCUMENTS

| | | |
|---|---|---|
| JP | 06-171002 | 6/1994 |
| JP | 06-171003 | 6/1994 |
| JP | 2002-115163 | 4/2002 |
| JP | 2004-353153 | 12/2004 |
| WO | 2005/010262 | 3/2005 |

* cited by examiner

*Primary Examiner*—Arti Singh-Pandey
(74) *Attorney, Agent, or Firm*—Fish & Richardson P.C.

(57) ABSTRACT

A reinforcing material for urethane foam effectively protects a molded urethane foam body and suppresses fricatives with a metal spring, having high productivity and excellent handleability and being applicable to a molded urethane foam body with highly uneven shape at low cost. It is a reinforcing material for urethane foam wherein a nonwoven fabric A having single fiber linear density of 1.0 to 3.0 dtex and a nonwoven fabric B having single fiber linear density of 0.5 to 2.5 dtex are laminated by needlepunching process by inserting needles from a direction of the nonwoven fabric A with a needle density of 35 to 70 needles/cm$^2$.

8 Claims, No Drawings

URETHANE FOAM REINFORCING MATERIAL

TECHNICAL FIELD

The present invention relates to a reinforcing material for urethane foam used for seats and the like, more particularly to a reinforcing material for urethane foam which effectively protects urethane foam from friction with a metal spring and the like, and further, which is excellent in handleability capable of being applied to urethane foam having a highly uneven shape.

BACKGROUND ART

Conventionally, urethane foam has been widely used as a cushioning material for seats and the like, and commonly used is one combined with a reinforcing material when a molded urethane foam body is formed. The reinforcing material is interposed between a molded urethane foam body and a metal spring, and plays roles of distributing cushioning effect of the metal spring as well as protecting the molded urethane foam body from friction arising from the metal spring. As the quality required by consumers is becoming higher, there has been a growing demand for eliminating fricatives generated by friction between urethane which has leaked into the reinforcing material and the metal spring, and as a reinforcing material responding to the demand, a reinforcing material having a bulky layer and a dense layer wherein the dense layer prevents leakage of urethane is proposed (for example, refer to Patent documents 1 and 2). However, problems are that, since such a reinforcing material has insufficient formability when forming urethane foam, if urethane foam having a highly uneven shape with high design quality which is in high demand in recent years is used for a molded body, such defects as wrinkling and breakage are formed, from which the leakage of urethane and the friction with the metal spring arise. Therefore, a reinforcing material using elastomer and the like which is flexible and can be used for forming urethane foam having a highly uneven shape is proposed (for example, refer to Patent document 3). However, the reinforcing material has problems of insufficient productivity and handleability. Namely, as a process for producing a reinforcing material, a few dozen layers of nonwoven fabric are piled up for stamping, and while the stamped nonwoven fabric is sewn by hand into a desired shape, the number of pieces to be piled during stamping is limited in production of a flexible nonwoven fabric using elastomer and the like, and variation of shapes becomes large and sewing becomes inaccurate, resulting in problems of productivity and quality.

[Patent document 1] Japanese unexamined patent publication No. 6-171002

[Patent document 2] Japanese unexamined patent publication No. 6-171003

[Patent document 3] Japanese unexamined patent publication No. 2004-353153

DISCLOSURE OF THE INVENTION

Problems to be Solved by the Invention

The present invention is made in view of the conventional art as a background, the object of the present invention is to provide a reinforcing material for urethane foam which effectively protects a molded urethane foam body and suppresses fricatives with metal spring having high productivity and excellent handleability, capable of being applied to a molded urethane foam body having highly uneven shape.

Means for Resolving the Problems

The present inventors intensively studied for solving the above problems, and finally accomplished the present invention. Namely, the present invention is (1) a reinforcing material for urethane foam wherein a nonwoven fabric A having single fiber linear density of 1.0 to 3.0 dtex and a nonwoven fabric B having single fiber linear density of 0.5 to 2.5 dtex are laminated by needlepunching process by inserting needles from a direction of nonwoven fabric A with a needle density of 35 to 70 needles/cm$^2$; (2) A reinforcing material for urethane foam, comprising a three-layer structure having nonwoven fabric A with single fiber linear density of 1.0 to 3.0 dtex as an outer layer and nonwoven fabric B with single fiber linear density of 0.5 to 2.5 dtex as an inner layer laminated by needlepunching process with a needle density of 35 to 70 needles/cm$^2$; (3) The reinforcing material for urethane foam according to (1) or (2) wherein the nonwoven fabric A has an initial modulus of 10 to 100 N/5 cm and elongation of 2 to 50%, and the nonwoven fabric B has an initial modulus of 30 to 200 N/5 cm and an elongation of 5 to 50%; and (4) The reinforcing material for urethane foam according to any one of (1) to (3), wherein the spunbonded nonwoven fabric B contains carbon black in an amount of 0.5 to 5% by weight.

Effects of the Invention

The present invention is advantageous in that the reinforcing material for urethane foam effectively protects a molded urethane foam body, suppresses fricatives with a metal spring and generates less leakage of urethane, and further, that it is excellent in stampability, high in productivity, easy to sew and excellent in handleability, and is capable of being applied to a molded urethane foam body having highly uneven shape.

DESCRIPTION OF THE PREFERRED EMBODIMENT

Hereinafter, the present invention will be explained in detail.

The reinforcing material for urethane foam of the present invention preferably comprises a nonwoven fabric A with single fiber linear density from 1.0 to 3.0 dtex and a nonwoven fabric B with single fiber linear density from 0.5 to 2.5 dtex laminated by needlepunching. Here, the nonwoven fabric A is impregnated with urethane during urethane foam forming, and while the nonwoven fabric B plays a role of preventing leakage of urethane, if single fiber linear density of the nonwoven fabric A is from 1.0 to 3.0 dtex, strong entanglement with the nonwoven fabric B by needlepunching is formed and the fabrics become inseparable and urethane is sufficiently impregnated to further secure an appropriate hardness, so that stampability becomes excellent and precise sewing is made possible. Further, if single fiber linear density of nonwoven fabric B is from 0.5 to 2.5 dtex, leakage of urethane can be effectively prevented, and durability against the friction with the metal spring will be excellent. More preferably, the nonwoven fabric A has a fineness of 1.5 to 2.5 dtex, even more preferably of 1.9 to 2.3 dtex. Additionally, the nonwoven fabric B more preferably has a single fiber linear density of 0.8 to 2.2 dtex, even more preferably of 1.0 to 2.0 dtex.

The reinforcing material for urethane foam of the present invention is preferably laminated at a needle density of 35 to 70 needles/cm$^2$ by needlepunching process. If the needle density is from 35 to 70 needles/cm$^2$, sewing will be carried out precisely while wrinkling and the like during foam formation can be effectively prevented. Namely, the present inventors discovered that by an addition of strong mechanical entanglement to the nonwoven fabric A and the nonwoven fabric B which are within the above range of fineness, entanglement will not be untangled and laminated body will be stretched so that precise sewing will be made possible. Further, during foam molding, fiber entanglement in a part having a highly uneven shape is untangled and is stretched in accordance with the previous shape, so that problems of wrinkling and the like can be prevented. When strong mechanical entanglement is formed, there will be an effect that after foam molding, an entangled point is strongly fixed due to urethane impregnation and modulus of elasticity in urethane impregnation layer is enhanced so that function of uniformly distributing cushioning effect from a metal spring is enhanced. Further, there will be an effect of preventing fuzz. A more preferable range is from 40 to 65 needles/cm$^2$, further preferably from 45 to 60 needles/cm$^2$.

If the reinforcing material for urethane foam of the present invention comprises two layers of the nonwoven fabric A and the nonwoven fabric B, needles for needlepunching process is preferably inserted from the layer of the nonwoven fabric A since the present inventors have discovered that a lamination can become more unified by inserting the needles from the layer of the nonwoven fabric A.

It is also one of preferred embodiments that the reinforcing material for urethane foam of the present invention has a three-layer structure comprising the nonwoven fabric A as an outer layer and the nonwoven fabric B as an inner layer. By having such a structure, fibers of the nonwoven fabric A penetrate nonwoven fabric B, and each of the nonwoven fabric A of two outer layers is entangled with each other so that the fabrics become inseparable.

The nonwoven fabric A used for foam molding material of the present invention preferably has an initial modulus of 10 to 100 N/5 cm. If it is in the range, more pieces of foam molding material can be piled for one stamping to improve productivity and the variation of shapes to be stamped will be smaller and precise sewing will be made possible. Further, fiber entanglement will be strong so that the fabrics become inseparable. A more preferable initial modulus is from 12 to 90N/5 cm, even more preferably from 13 to 80 N/5 cm. A measure for obtaining the nonwoven fabric A having the initial modulus property is not particularly limited, but if the fabric is heat pressed by embossing, it can be obtained by adjusting a temperature for heat-press bonding, and for example, if a material constituting the nonwoven fabric A is polyethylene terephthalate, it can be obtained by setting the temperature at about 175 to 210° C.

The nonwoven fabric B used for the foam molding material of the present invention preferably has an initial modulus in a range from 30 to 200 N/5 cm. If it is in the range, more pieces of foam molding material can be piled for one stamping to improve productivity and the variation of shapes to be stamped out will be smaller and precise sewing will be made possible in a same manner as the above-described nonwoven fabric A; additionally, it has an effect of preventing leakage of urethane effectively. A more preferable initial modulus is from 33 to 190 N/5 cm, even more preferably from 35 to 180 N/5 cm. A measure for obtaining nonwoven fabric B having the initial modulus property is not particularly limited, but if the fabric is heat pressed by embossing, it can be obtained by adjusting a temperature for heat-press bonding, and for example, if a material constituting the nonwoven fabric A is polyethylene terephthalate, it can be obtained by setting the temperature at about 190° C. to 230° C.

The nonwoven fabric B used for the reinforcing material for urethane foam of the present invention preferably contains carbon black in an amount of 0.5 to 3% by weight since the present inventors discovered that local leakage of urethane can be prevented by including carbon black. A main reason that the local leakage of urethane can be prevented by including carbon black is not clear, but possible reasons are as follows. Namely, one of the possible reasons is that fibers containing carbon black becomes low in friction resistance so that it is possible to disperse fibers during production of the nonwoven fabric B, and/or it becomes easier to open fibers when opening fibers using electricity after spinning the polymer so that uniformity of the nonwoven fabric is enhanced. Further, another one of the possible reasons is that if the nonwoven fabric is subjected to hot embossing using heat press rolls, embossing is carried out effectively and an embossed area is almost perfectly formed into film form to prevent leakage of urethane. A more preferred amount to be added is from 0.6 to 2.5% by weight, even more preferably from 0.8 to 3% by weight.

The nonwoven fabric used for the reinforcing material for urethane foam of the present invention is preferably hot-embossed spunbonded nonwoven fabric since the hot embossed spunbonded nonwoven fabric has less fluff and is excellent in wear-resistance, and further, it can control air permeability and preventive performance of leakage of urethane with high precision. Preferable conditions for hot embossing include linear pressure from 10 to 40 kN/m and a percentage of the embossed area from 8 to 30% with respect to the nonwoven fabric A, and with respect to nonwoven fabric B, a linear pressure from 20 to 50 kN/m and a percentage of the embossed area from 8 to 30%.

A weight of the nonwoven fabric A used for the reinforcing material for urethane foam of the present invention is preferably from 30 to 150 g/m$^2$. If it is 30 g/m$^2$ or less, fiber entanglement becomes insufficient and the fabric will be broken during a process of urethane foam, leading to urethane leakage. If it is 150 g/m$^2$ or more, cutting performance deteriorates and it will be difficult for a ground fabric to follow the mold during foam forming.

A weight of nonwoven fabric B used for the reinforcing material for urethane foam of the present invention is preferably from 20 to 100 g/m$^2$. If it is 100 g/m$^2$ or more, penetration resistance of needle at the time of needle entanglement becomes large so that there will be problems of needle break and the like.

EXAMPLES

Hereinafter, the present invention will be described in more detail with reference to Examples, but the present invention is not restricted by the following Examples.

Evaluation method of property values described in the present invention is as follows.

[Stress in 5% elongation and tensile strength of laminated nonwoven fabric] (N/5 cm): With respect to 20 sample pieces having a width of 50 mm and a length of 200 mm obtained along the width of the laminated nonwoven fabric, the stress in 5% elongation and the tensile strength were measured at a grip distance of 100 mm and tensile speed of 200 mm/minute in accordance with cut strip method described in JIS L-1096 using Constant-Rate-of-Extension Type Tensile Testing Machine (TENSILON manufactured by ORIENTEC Co., LTD) and average values thereof were determined as the stress (N/5 cm) in 5% elongation and the tensile strength (N/5 cm).

[Nonwoven fabric fineness] (dtex): Specimens sampled from any portion of the nonwoven fabric was set on an optical microscope provided with a digital eyepiece micrometer so as to observe a cut surface of the specimens, and with respect to any 50 fibers cut off almost perpendicular to a direction intersecting an axis of the fibers, lengths of long and short axes of cut surface of the fibers were measured to calculate an area of the cut surface of each of the fibers and obtain the average of the values which was to be the area of the cut surface of the fibers. Separately, fiber density was calculated to apply to calculation of weight at a length of 10,000 m.

[Weight]

Six pieces of specimen of 20 cm×5 cm were taken per 1 m width of the nonwoven fabric to measure the weight, and the average value thereof is shown per unit area.

[Evaluation of Occurrence of Fricatives]

In a model test of occurrence of noise wherein a surface of the nonwoven fabric A was brought to contact with a spring and application of pressure and depressurization were repeated, the presence or absence of noise was examined.

[Evaluation of Stampability]

Ten tons of cutting pressure was applied by hydraulic cutting machine. A wooden setting board was set on an underside of the cutting machine, and 20 pieces of nonwoven fabric are folded and set thereon. A formwork of 40 cm×30 cm combined with a blade for cutting was set on the nonwoven fabric to cut by a press of the cutting machine. The evaluation is based on pass (○): nonwoven fabric can be cut well without fuzz; and fail (x): Scissors, a cutter or the like had to be used for cutting since there is fuzz, or scissors, a cutter or the like had to be used for cutting since a part of the nonwoven fabric was not cut.

[Evaluation of Sewing]

There is an operation in which the nonwoven fabric is cut sterically as a receiving material for a car seat spring in a shape of a frame of the seat. The nonwoven fabric is sewn by sewing machine while being stretched. In accordance with the evaluation method of "Stress in 5% elongation and tensile strength of laminated nonwoven fabric" described above, stress in 5% elongation is evaluated. The higher the stress in 5% elongation is, the higher dimensional stability when sewing becomes, and thus it is preferable. As the standard of judgment of whether it is good or not, it is preferred that stress in 5% elongation is 18 N/5 cm or more.

[Evaluation of Urethane Leakage Property]

The nonwoven fabric was attached on an upper side of a mold in which there was an air release hole for foaming gas in the mold for urethane foam molding, and in accordance with a conventional method, a foamable urethane resin was added thereto to carry out polyurethane foam molding under heated and pressurized condition, thereby foam molded product of a flexible polyurethane foam in a mold was produced.

In order to examine the penetration and permeation of polyurethane resin of the nonwoven fabric in the resultant molded product as well as bonding condition between polyurethane foam layer and the nonwoven fabric having the laminated structure, the resultant molded product was cut off to observe the condition of a cut surface and measure the bond strength between the polyurethane foam layer and the nonwoven fabric having a laminated structure.

Example 1

A nonwoven fabric A produced by spunbonding, in which a web of random loop texture having a weight of 55 g/m$^2$ comprising polyethylene terephthalate fibers of 2.5 dtex was temporary heat-press bonded by calendering using a heat roll at 170° C., and a Nonwoven fabric B manufactured in a same manner by spunbonding containing carbon black in an amount of 2%, in which a web of random loop texture having a weight of 40 g/m$^2$ comprising polyethylene terephthalate fibers of 1.2 dtex was heat-press bonded by calendering using a heat roll were laminated and are subjected to needlepunching using a needle of FPD1-40S manufactured by Organ Needle Co., Ltd. with a needle density of 50 needles/cm$^2$ and a needle depth of 14 mm to obtain a nonwoven fabric having a two-layer laminated structure. A stress of nonwoven fabric A in 5% elongation was 15 N/5 cm in a longitudinal direction and 8 N/5 cm in a lateral direction, while a stress of nonwoven fabric B in 5% elongation was 41 N/5 cm in a longitudinal direction and 27 N/5 cm in a lateral direction.

Example 2

In Example 1, the nonwoven fabric A was laminated on both sides of the nonwoven fabric B for needlepunching at a needle density of 50 needles/cm$^2$ and a needle depth of 14 mm using a needle of FPD1-40S manufactured by Organ Needle Co., Ltd. to obtain a nonwoven fabric having a three-layer laminated structure.

Comparative Example 1

A nonwoven fabric 1 produced by spunbonding in which a web of random loop texture comprising polyethylene terephthalate having a weight of 55 g/m$^2$ comprising fibers of 3 dtex was temporarily heat-press bonded by calendering using heat rolls at 170° C. and a nonwoven fabric 2 produced in a same manner by spunbonding in which a web of random loop texture comprising polyethylene terephthalate fibers of 1.5 dtex having a weight of 40 g/m$^2$ was heat-press bonded by calendering using heat rolls at 200° C. were laminated and were subjected to needlepunching using needles of FPD1-40S manufactured by Organ Needle Co., Ltd. with a needle density of 40 needles/cm$^2$ and a needle depth of 14 mm to obtain a nonwoven fabric having a two-layer laminated structure.

Comparative Example 2

On a side of the nonwoven fabric 2 of the nonwoven fabric having a two-layer laminated structure obtained in Comparative example 1, a nonwoven fabric 3 produced in a same manner as the nonwoven fabric 1 was further piled, and the fabrics were subjected to needlepunching using needles of FPD1-40S produced by Organ Needle Co., Ltd. with a needle density of 40 needles/cm$^2$ and a needle depth 14 mm to form an entanglement to obtain a nonwoven fabric having a three-layer laminated structure.

Evaluation results of Examples and Comparative examples are shown in Table 1.

| Category | Item | Detail | Unit | Example 1 | Example 2 | Example 3 | Example 4 |
|---|---|---|---|---|---|---|---|
| Structure and processing method | Nonwoven fabric A or 1 | Weight | $g/m^2$ | 55 | 55 | 55 | 55 |
| | | Fineness | dtex | 2.5 | 2.5 | 3 | 3 |
| | | Temperature of heat press rolls | ° C. | 190 | 190 | 170 | 170 |
| | | Stress in 5% elongation (in longitudinal direction) | N/5 cm | 18 | 18 | 12 | 12 |
| | | Stress in 5% elongation (in lateral direction) | N/5 cm | 9 | 9 | 5 | 5 |
| | Nonwoven fabric B or 2 | Weight | $g/m^2$ | 40 | 40 | 40 | 40 |
| | | Fineness | dtex | 1.2 | 1.2 | 1.5 | 1.5 |
| | | Temperature of heat press rolls | ° C. | 210 | 210 | 200 | 200 |
| | | Stress in 5% elongation (in longitudinal direction) | N/5 cm | 49 | 49 | 35 | 35 |
| | | Stress in 5% elongation (in lateral direction) | N/5 cm | 27 | 27 | 23 | 23 |
| | Lamination process | Needle density | needle(s)/$cm^2$ | 50 | 55 | 40 | 40 |
| | | Needle depth | mm | 14 | 14 | 14 | 14 |
| Evaluation | Urethane leaking | — | — | No leaking | No leaking | Partial leaking | Partial leaking |
| | Impregnation of urethane and nonwoven fabric | — | — | High impregnation and material failure | High impregnation and material failure | High impregnation and material failure | High impregnation and material failure |
| | Presence of fricatives | — | — | None | None | Slightly present | Slightly present |
| | Punching quality | — | — | ○ | ○ | x | x |
| | Evaluation of sewing | Stress in 5% elongation (in longitudinal direction) | N/5 cm | 29 | 36 | 20 | 30 |
| | | Stress in 5% elongation (in lateral direction) | N/5 cm | 20 | 25 | 13 | 15 |

In Examples 1 and 2, there was no leakage during urethane foam formation, and urethane impregnation was good, and in a case of implementing a delamination measurement, material failure of urethane occurred. Further, it was found that no fricative occurred by a contact between the nonwoven fabric and the spring. In evaluation of stamping quality, no fuzz or defective cutting was detected, and it was found that the fabric could be cut in an excellent condition. In evaluation of sewing, stress in 5% elongation was 20 N/5 cm or more, and it was found that sewing within an acceptable size range was made possible by suppressing an excessive stretching of the nonwoven fabric during sewing operation.

In Comparative examples 1 and 2, slight leakage occurred from a nonuniform portion (with smaller density) of nonwoven fabric B during urethane foam forming. Although there was no problem of impregnation, in the evaluation of stamping, it was found that fuzz was formed and partial defective cutting occurred. In the evaluation of sewing, too, the stress of nonwoven fabric in 5% elongation was 17 N/5 cm or less, and it was found that, during the sewing operation, too, nonwoven fabric was partially stretched and sewing within an acceptable size range was impossible.

INDUSTRIAL APPLICABILITY

The present invention can provide a reinforcing material for urethane foam which effectively protects a molded urethane foam body and suppresses fricatives with a metal spring, having high productivity and excellent handleability and being applicable to a molded urethane foam body with highly uneven shape at low cost, which contributes much to industry.

What is claimed is:

1. A reinforcing material for urethane foam wherein a nonwoven fabric A having single fiber linear density of 1.0 to 3.0 dtex and a nonwoven fabric B having single fiber linear density of 0.5 to 2.5 dtex are laminated by needlepunching process with a needle density of 35 to 70 needles/$cm^2$ by inserting needles from a direction of nonwoven fabric A.

2. The reinforcing material for urethane foam according to claim 1, wherein the nonwoven fabric A has an initial modulus of 10 to 100 N/5 cm and elongation of 2 to 50% while the nonwoven fabric B has an initial modulus of 30 to 200 N/5 cm and an elongation of 5 to 50%.

3. The reinforcing material for urethane foam according to claim 1, wherein the nonwoven fabric B contains carbon black in an amount of 0.5 to 5% by weight.

4. The reinforcing material for urethane foam according to claim 1, wherein the nonwoven fabric A has an initial modulus of 10 to 100 N/5 cm and elongation of 2 to 50% while the nonwoven fabric B has an initial modulus of 30 to 200 N/5 cm and an elongation of 5 to 50%, and contains carbon black in an amount of 0.5 to 5% by weight.

5. A reinforcing material for urethane foam, comprising a three-layer structure having a nonwoven fabric A with single fiber linear density of 1.0 to 3.0 dtex as an outer layer and a nonwoven fabric B with single fiber linear density of 0.5 to 2.5 dtex as an inner layer laminated by needlepunching process with a needle density of 35 to 70 needles/$cm^2$.

6. The reinforcing material for urethane foam according to claim 5, wherein the nonwoven fabric A has an initial modulus of 10 to 100 N/5 cm and elongation of 2 to 50% while the nonwoven fabric B has an initial modulus of 30 to 200 N/5 cm and an elongation of 5 to 50%.

7. The reinforcing material for urethane foam according to claim 5, wherein the nonwoven fabric B contains carbon black in an amount of 0.5 to 5% by weight.

8. The reinforcing material for urethane foam according to claim 5, wherein the nonwoven fabric A has an initial modulus of 10 to 100 N/5 cm and elongation of 2 to 50% while the nonwoven fabric B has an initial modulus of 30 to 200 N/5 cm and an elongation of 5 to 50%, and contains carbon black in an amount of 0.5 to 5% by weight.

* * * * *